US008225779B2

(12) United States Patent
Evans

(10) Patent No.: US 8,225,779 B2
(45) Date of Patent: Jul. 24, 2012

(54) CABLE GUARD ELIMINATOR

(75) Inventor: John D. Evans, Calgary (CA)

(73) Assignee: EVCO Technology & Development Company Ltd., Calgary, Alberta (CA)

( * ) Notice: Subject to any disclaimer, the term of this patent is extended or adjusted under 35 U.S.C. 154(b) by 622 days.

(21) Appl. No.: 11/968,459

(22) Filed: Jan. 2, 2008

(65) Prior Publication Data

US 2009/0165766 A1 Jul. 2, 2009

(51) Int. Cl.
*F41B 5/14* (2006.01)

(52) U.S. Cl. ..... 124/90; 124/23.1; 124/25.6; 124/44.5; 124/86; 124/92

(58) Field of Classification Search ..... 124/23.1, 124/25.6, 44.5, 86, 90, 92
See application file for complete search history.

(56) References Cited

U.S. PATENT DOCUMENTS 4,440,142 A * 4/1984 Simonds ..... 124/25.6
4,452,222 A * 6/1984 Quartino et al. ..... 124/23.1
4,542,732 A * 9/1985 Troncoso ..... 124/25.6
4,733,648 A * 3/1988 Martin ..... 124/86
4,781,167 A * 11/1988 Martin ..... 124/25.6
4,834,061 A * 5/1989 Chattin ..... 124/86
4,903,678 A * 2/1990 Walker ..... 124/90
4,909,231 A * 3/1990 Larson ..... 124/23.1
4,917,070 A * 4/1990 Townsend ..... 124/23.1
5,178,122 A * 1/1993 Simonds ..... 124/25.6
5,307,787 A * 5/1994 LaBorde et al. ..... 124/25.6
5,623,915 A * 4/1997 Kudlacek ..... 124/25.6
5,694,914 A * 12/1997 Henschel ..... 124/86
5,722,385 A * 3/1998 Bunk ..... 124/86
6,371,098 B1 * 4/2002 Winther ..... 124/23.1
6,474,324 B1 * 11/2002 Despart et al. ..... 124/25.6
6,532,945 B1 * 3/2003 Chattin ..... 124/25.6
6,659,096 B1 * 12/2003 Nealy et al. ..... 124/25.6
6,708,684 B2 * 3/2004 Chattin ..... 124/25.6
6,715,479 B1 * 4/2004 Bunk ..... 124/25.6
6,722,354 B1 * 4/2004 Land ..... 124/25.6
6,729,320 B1 * 5/2004 Terry ..... 124/25.6
6,758,204 B1 * 7/2004 Goff et al. ..... 124/25.6
6,763,818 B2 * 7/2004 Larson ..... 124/25.6
6,792,930 B1 * 9/2004 Kronengold et al. ..... 124/25.6
6,889,679 B2 * 5/2005 Chattin ..... 124/25.6
7,066,165 B2 * 6/2006 Perry ..... 124/23.1
7,231,915 B2 * 6/2007 McPherson et al. ..... 124/90
8,028,685 B2 * 10/2011 Clark ..... 124/25.6
2010/0083943 A1 * 4/2010 Grace et al. ..... 124/25.6
2011/0011385 A1 * 1/2011 Grace et al. ..... 124/25.6
2011/0048394 A1 * 3/2011 Simo et al. ..... 124/25.6

* cited by examiner

*Primary Examiner* — Gene Kim
*Assistant Examiner* — Alexander Niconovich
(74) *Attorney, Agent, or Firm* — Richard Johnson; Oyen, Wiggs, Green & Mutala LLP

(57) ABSTRACT

A cable guard eliminator for a compound bow comprising a first limb and a second limb and having a bowstring and at least one cable strung between first and second connecting elements respectively mounted near outer ends of the first and second limbs. The cable guard eliminator comprises a first portion from which the cable extends to the first connecting element, a second portion from which the cable extends to the second connecting element, and, an intermediate portion defining a deflection area between the first end and the second end. The deflection area has a length in a direction generally parallel to the cable at least as long as a range of motion of the cable, such that at least some portion of the deflection area remains aligned with an arrow path throughout drawing and release of the bowstring.

15 Claims, 13 Drawing Sheets

20
14
28
100'
32
100
10
12
16
22

24
20
14
34
28
200
32
30
200'
12
10
36
16
24
22

CABLE GUARD ELIMINATOR

TECHNICAL FIELD

The present application relates to compound archery bows. Certain embodiments provide a cable guard eliminator for a compound archery bow in which one or more cables extend between ends of the limbs of the bow.

BACKGROUND

Compound archery bows typically have one or more portions of cable extending between the limbs of the bow. Such cable portions, sometimes referred to as "power cables", are generally located at least partly within or close to an operating plane of a bowstring on which an arrow may be nocked, which also extends between the limbs of the bow. The power cables can thus interfere with shooting arrows.

In order to provide adequate room for the arrow, it is conventional practice to mount a cable guard on the bow to engage the central portions of the power cables and to displace them laterally a sufficient distance to one side of the operating plane of the bowstring to avoid interference with an arrow. By offsetting the central portions of the power cables from the plane of the bowstring, tension in the power cables during operation of the bow in projecting an arrow, creates off-center torque which not only decreases the accuracy of arrow flight, but also causes twisting of the limbs, cams, wheels and/or handle, and thereby contributes adversely to shortening their useful life.

U.S. Pat. No. 5,623,915 provides a power cable system in which two pairs of parallel, laterally spaced power cable stretch segments extend parallel to and symmetrical with respect to the operating plane of a bowstring extending between eccentric cams mounted on the outer ends of bow limbs by cam shafts. This arrangement divides the cable strands in half. The halves of the cable are anchored to the ends of the cam axle on the outside of the limbs. The other ends of the cable are anchored to the cam. The arrow passes between both the halves of the cables when the arrow is nocked. In order for the arrow to be nocked, the arrow has to be fed through the halves of the cable.

The inventor has determined a need for improved systems for displacing power cables of compound bows such that arrows can be shot without interference from the power cables.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

One aspect of the invention provides a cable guard eliminator for a compound bow comprising a first limb and a second limb and having a bowstring and at least one cable strung between first and second connecting elements respectively mounted near outer ends of the first and second limbs. The cable guard eliminator comprises a first portion from which the cable extends to the first connecting element, a second portion from which the cable extends to the second connecting element, and, an intermediate portion defining a deflection area between the first end and the second end, the deflection area having a length in a direction generally parallel to the cable at least as long as a range of motion of the cable, such that at least some portion of the deflection area remains aligned with an arrow path throughout drawing and release of the bowstring.

Another aspect of the invention provides a cable-guard eliminator for a compound bow. The bow has a first limb, a second limb, and a handle mounting the first limb and second limb, the outer ends of each of the first and second limbs mounting one or more eccentric cams or wheels on mounting shafts, a bowstring secured to each cam and extending from the first limb to the second limb, and one or more power cables having a first segment attached to the first limb by the mounting shafts and a second segment attached to the second limb directly to a cam. The cable-guard eliminator has a first portion attached to the first segment of each power cable, a second portion attached to the second segment of each power cable, and an intermediate portion connecting the first portion and second portion. The intermediate portion is deflected out of the operating plane of the bowstring, thereby eliminating the need for a cable-guard to deflect the power cables from the operating plane of the bowstring.

Further aspects of the invention and details of example embodiments are described below.

BRIEF DESCRIPTION OF DRAWINGS

In drawings which illustrate non-limiting embodiments of the invention.

DETAILED DESCRIPTION OF THE PREFERRED EMBODIMENT

Exemplary embodiments are illustrated in referenced figures of the drawings. It is intended that the embodiments and figures disclosed herein are to be considered illustrative rather than restrictive.

Figure 1:
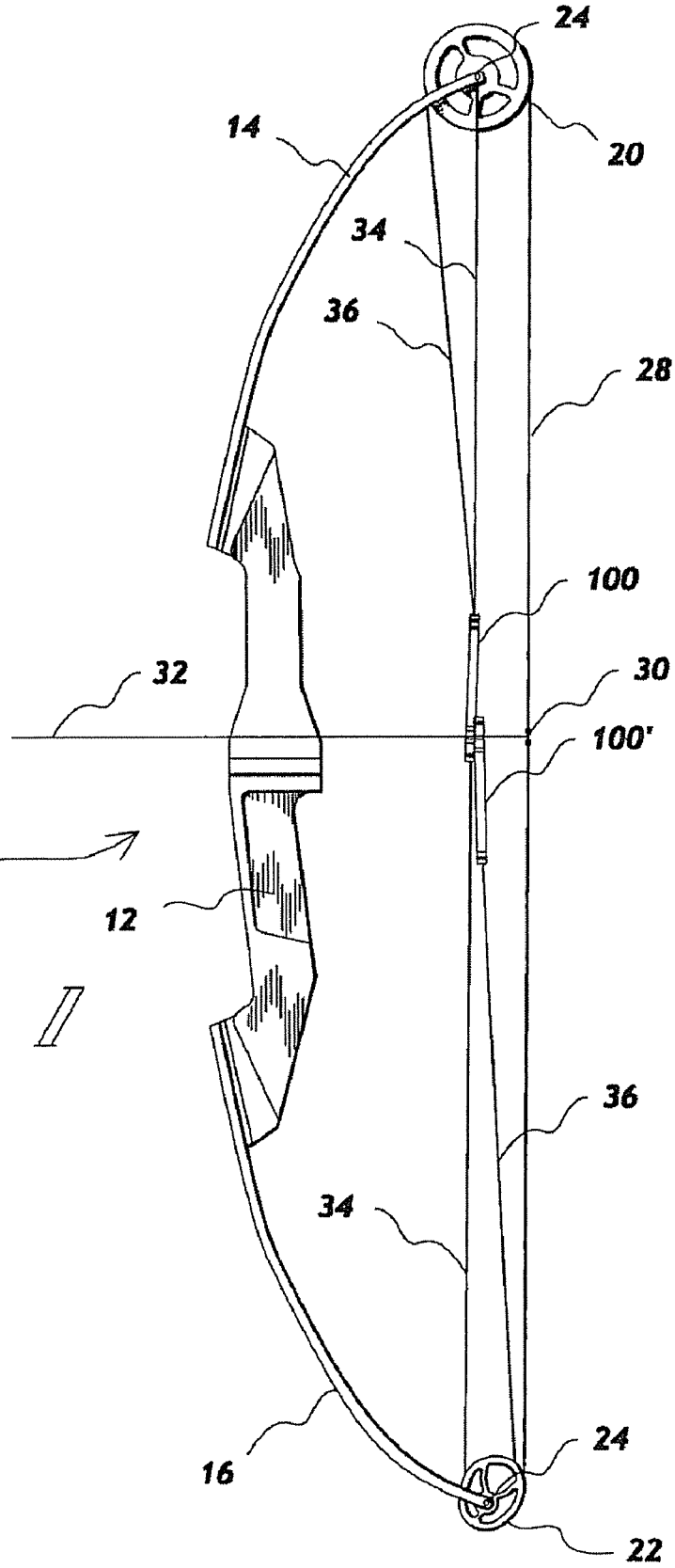
FIG. 1 is a side view of a compound bow with two cable guard eliminators coupled to power cables according to one embodiment of the invention.

Referring to FIG. 1, a compound archery bow includes a handle 10 with a hand grip 12. Limbs 14 and 16 extend outwardly from handle 10 in opposite directions. Rotating members 20 and 22 are pivotally coupled to outer ends of limbs 14 and 16, respectively, by mounting shafts 24. Rotating members 20 and 22 may comprise, for example, two cams (for a dual cam compound bow), or a cam and a pulley or wheel (for a single cam or "cam and a half" compound bow). Other arrangements of rotating members 20 and 22 are also possible.

A bowstring 28 extends between rotating members 20 and 22 at the ends of limbs 14 and 16. Bowstring 28 is wound around rotating members 20 and 22 such that when a user pulls back on bowstring 28 to draw the bow, bowstring 28 unwinds from the back sides of both rotating members 20 and 22. The terms "front" and "back" (and derivatives thereof) are used herein to respectively refer to the direction of an arrow's flight when shot from the bow, and the opposite direction. Bowstring 28 is provided with a nock 30 for locating the slotted nock end of an arrow 32.

Power cables 34 and 36 also extend between the ends of limbs 14 and 16. Power cables 34 and 36 are coupled to rotating members 20 and 22 such that when a user pulls back on bowstring 28 to draw the bow and bowstring 28 unwinds from the back sides of rotating members 20 and 22, power cables 34 and 36 are wound onto the front sides of rotating members 20 and 22, thereby pulling the ends of limbs 14 and 16 together.

Rotating members 20 and 22 typically have sheaves defined therein for receiving bowstring 28 and power cables 34 and 36. The sheaves may have varying shapes and degrees of eccentricity, depending on the type of bow. At least one of power cables 34 or 36 may be anchored at one end thereof to a mounting shaft 24 of rotating member 20 or 22, in which case the end of the power cable so anchored may be split into two strands, with one strand attached to each side of mounting shaft 24. In some embodiments, power cables 34 and/or 36 may be anchored at one end thereof to a point along one of the sheaves of rotating member 20 or 22. Power cables 34 and 36 and bowstring 28 may comprise portions of a single elongated element in some embodiments. In other embodiments, power cables 34, 36 and/or bowstring 28 may comprise separate elongated elements joined together and/or mounted to points on rotating members 20 and/or 22. As one skilled in the art will appreciate, numerous types of compound bows with varying arrangements of cams, pulleys, power cables and bowstrings are possible, and embodiments of the present invention could be used with any type of compound bow, including, without limitation, compound bows having only one power cable, only one rotating member, more than two power cables, and/or more than two rotating members.

In the example shown in FIGS. 1 to 4, a cable guard eliminator 100 according to one embodiment of the invention is coupled to power cable 34, and another cable guard eliminator 100' is coupled to power cable 36. Cable guard eliminator 100 comprises a first portion 110 from which cable 34 extends toward the end of limb 14, a second portion 120 from which cable 34 extends toward the end of limb 16, and an intermediate portion 130 connecting the first portion 110 to the second portion 120. Intermediate portion 130 is deflected out of the operating plane of the bowstring 28 to define a deflection area. The deflection area defined by intermediate portion 130 may be at least as long as a range of motion of cable 34 during drawing and releasing of the bow. First portion 110 and second portion 120 may be generally parallel to bowstring 28 and cables 34 and 36. Cable guard eliminator 100' may be of substantially similar construction to cable guard eliminator 100, or may be differently configured as discussed further below.

Figure 11:
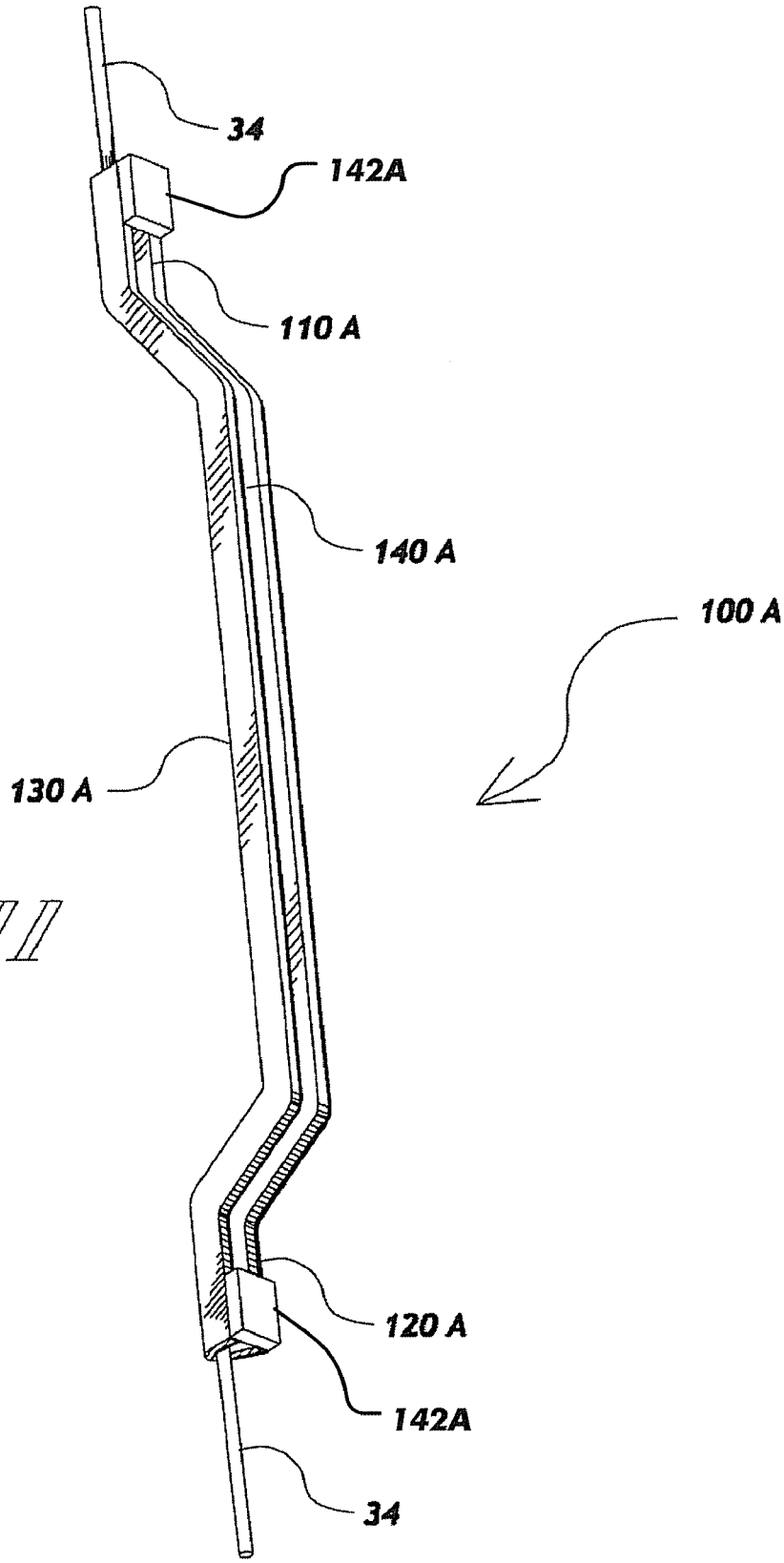
FIG. 11 shows a cable guard eliminator coupled to a power cable according to another embodiment of the invention.
Figure 12:
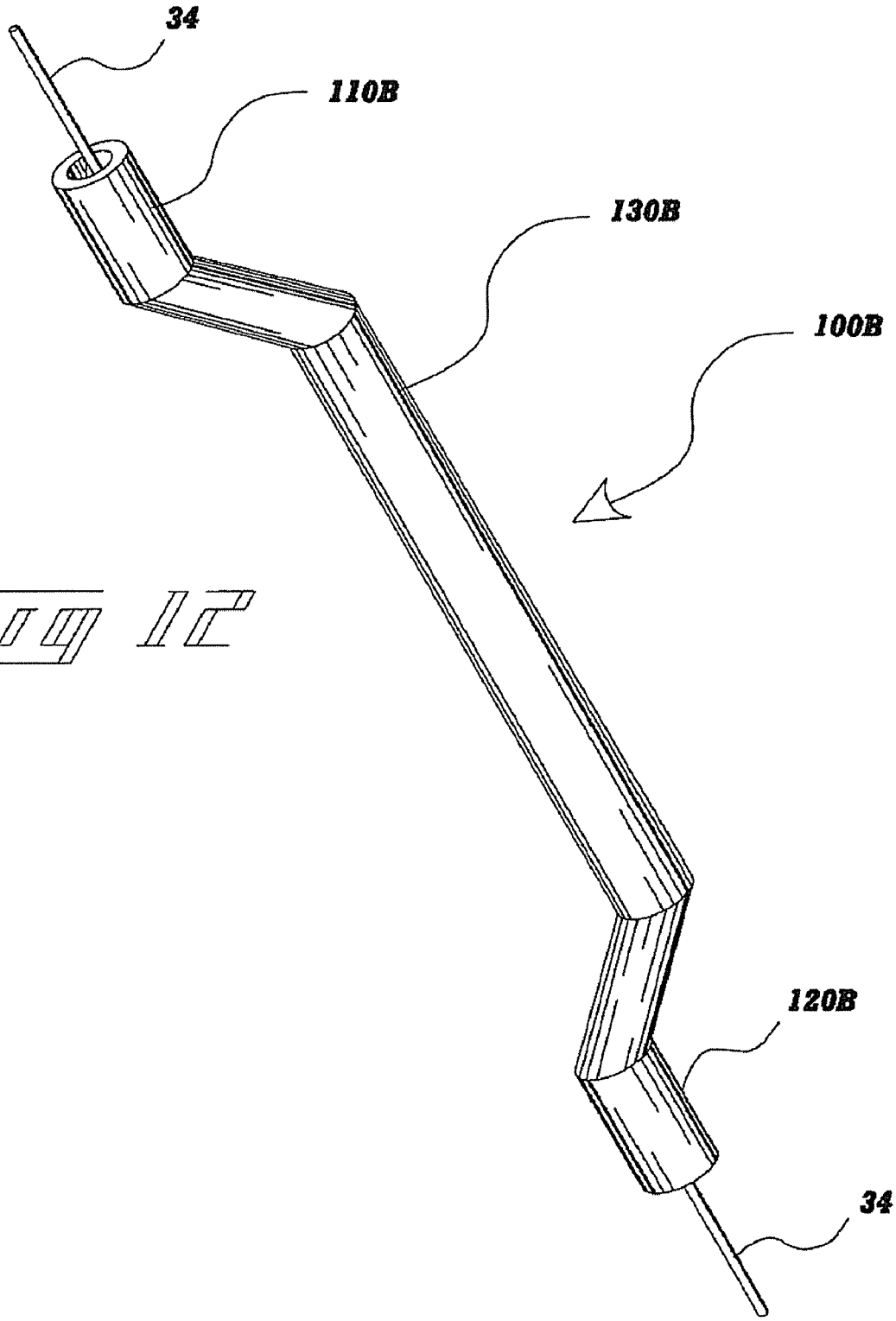
FIG. 12 shows a cable guard eliminator coupled to a power cable according to another embodiment of the invention.
Figure 13:
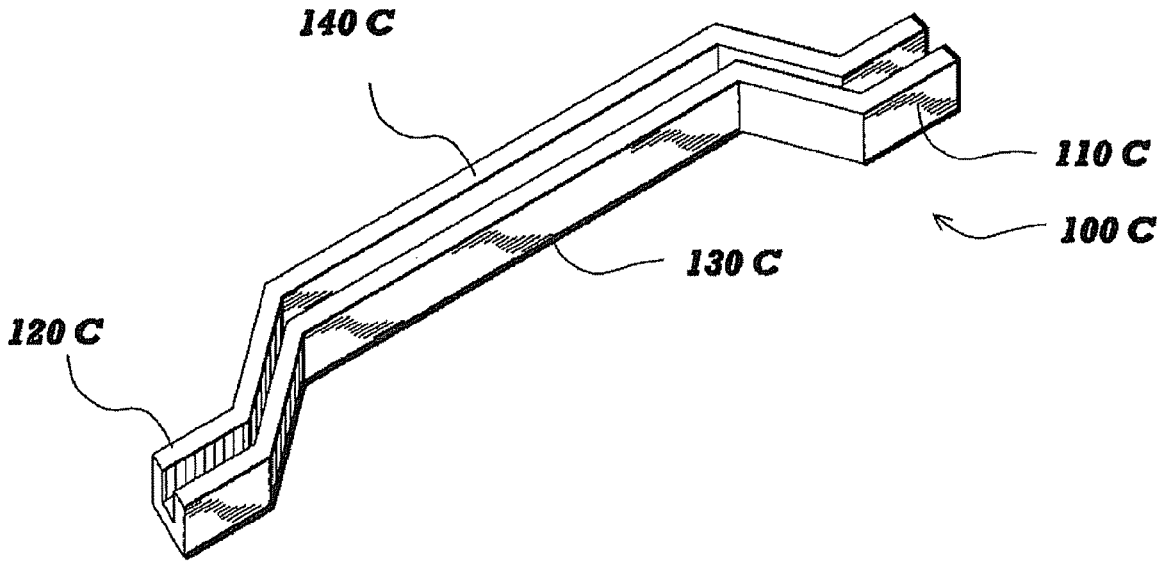
FIGS. 13 and 14 show cable guard eliminators according to other embodiments of the invention in isolation.
Figure 14:
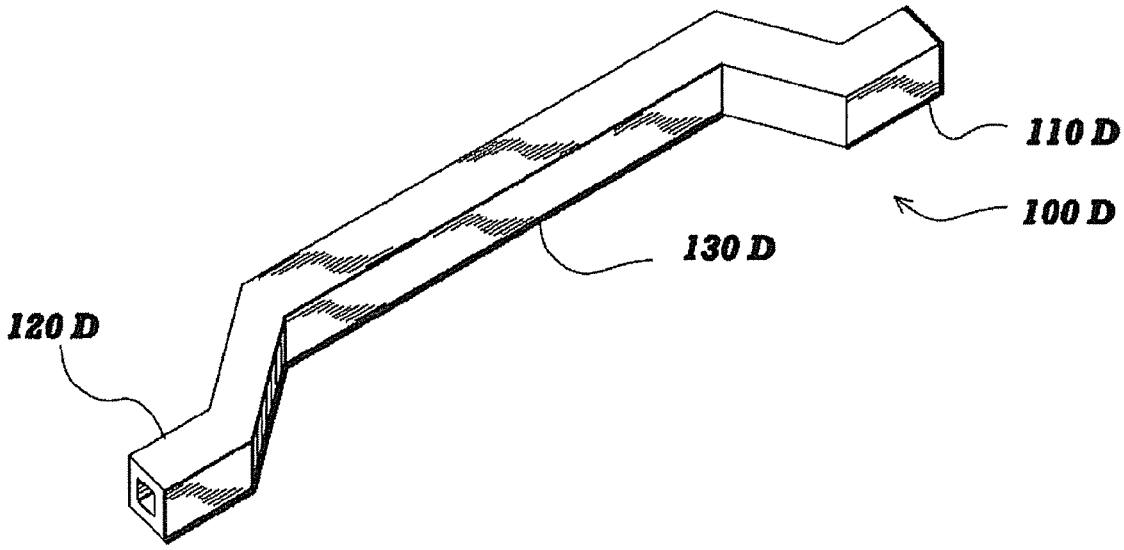

In the example embodiment shown in FIGS. 1-4, cables 34 and 36 are each partitioned into two segments, with a first segment attached to first portion 110 (110') and a second segment attached to second portion 120 (120'). In other embodiments, cable guard eliminator 100 (or 100') may be configured to be coupled to a continuous cable 34 (or 36). For example, cable 34 may be received in a trench or slot defined in cable guard eliminator 100 (as shown in FIGS. 11 and 13), or cable guard eliminator 100 may be hollow or have a hollow core, with cable 34 fed therethrough (as shown in FIGS. 12 and 14). In such embodiments, cable guard eliminator 100 is preferably sufficiently rigid to withstand tension in cable 34 without significant deformation.

Figure 2:
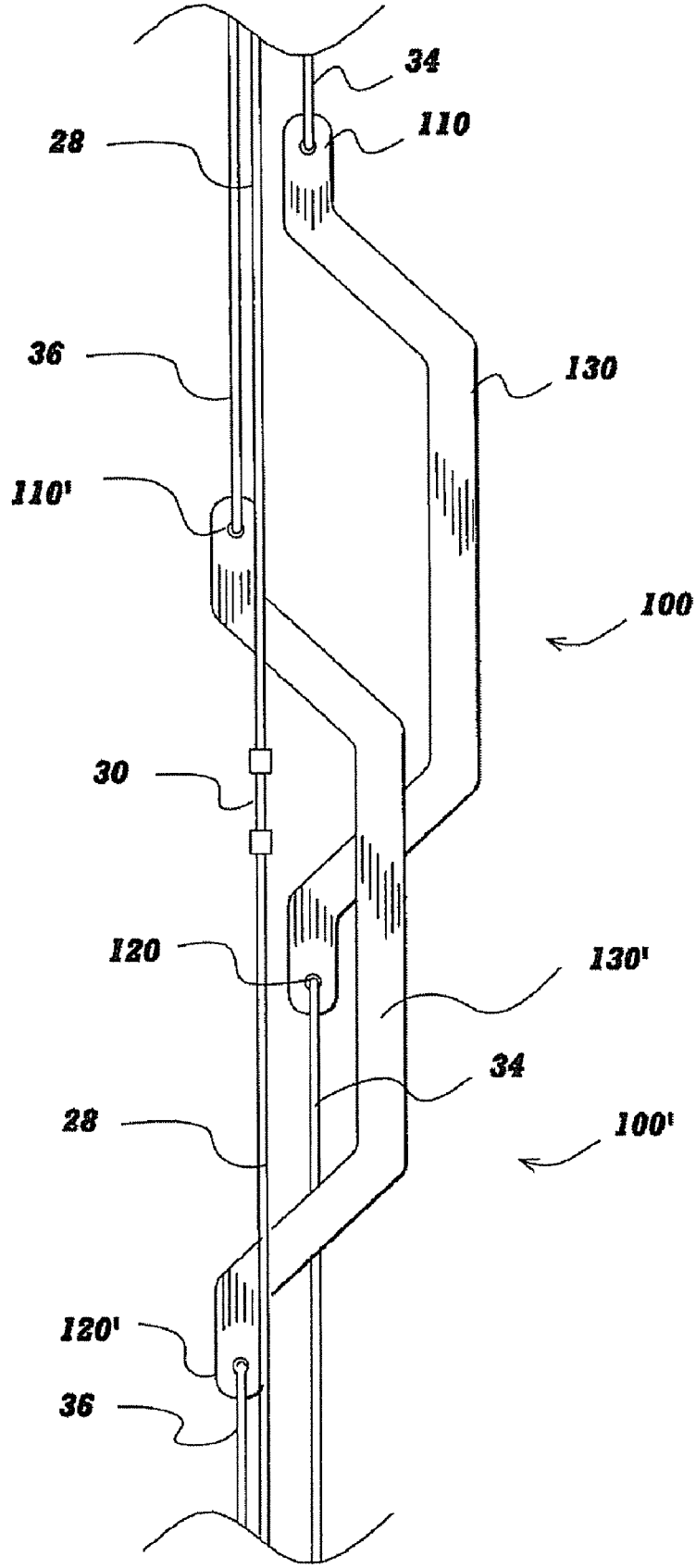
FIG. 2 is a rear view showing the bowstring, power cables and cable guard eliminators of FIG. 1 in isolation.
Figure 3:
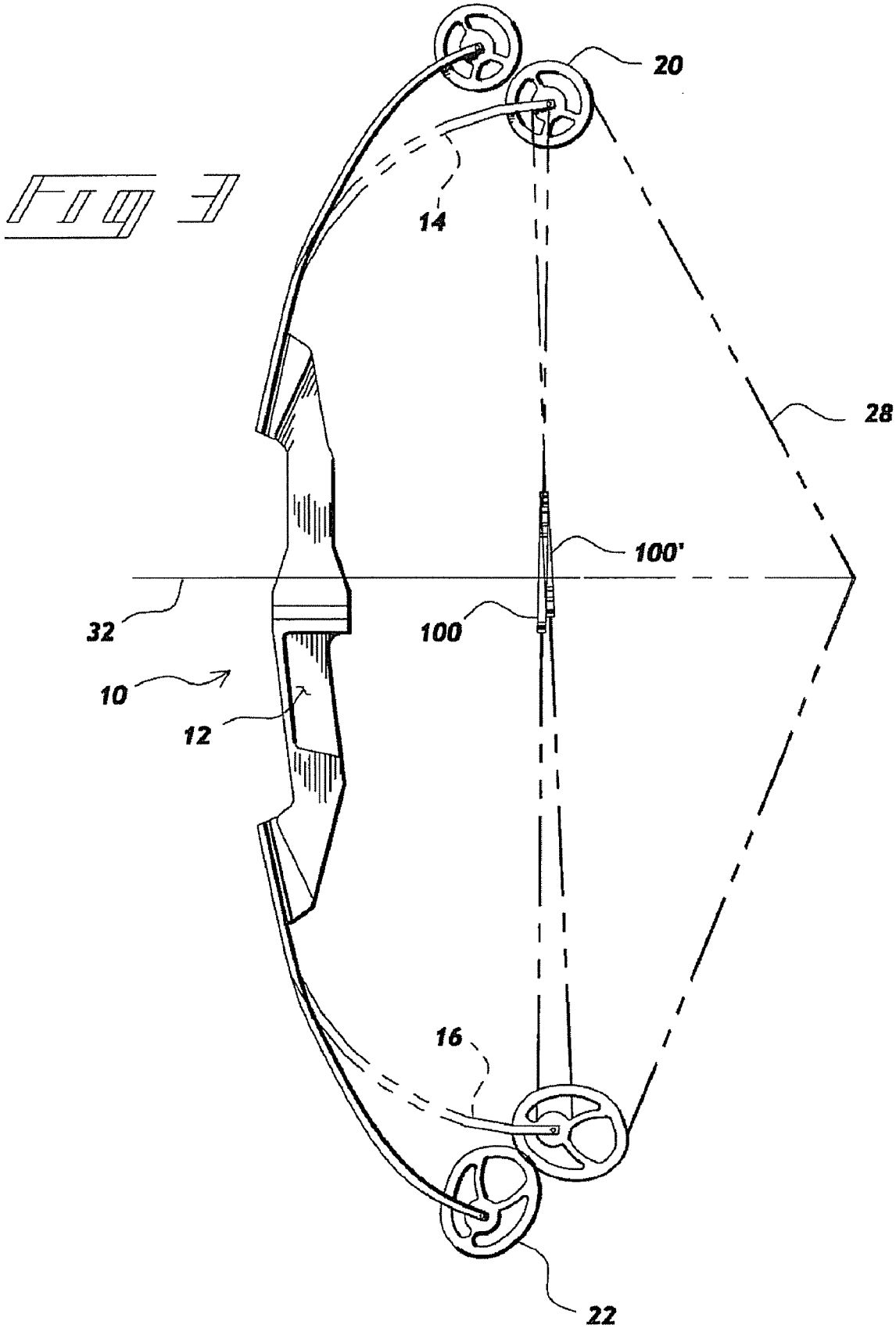
FIG. 3 is a side view of the compound bow of FIG. 1 at full draw.
Figure 4:
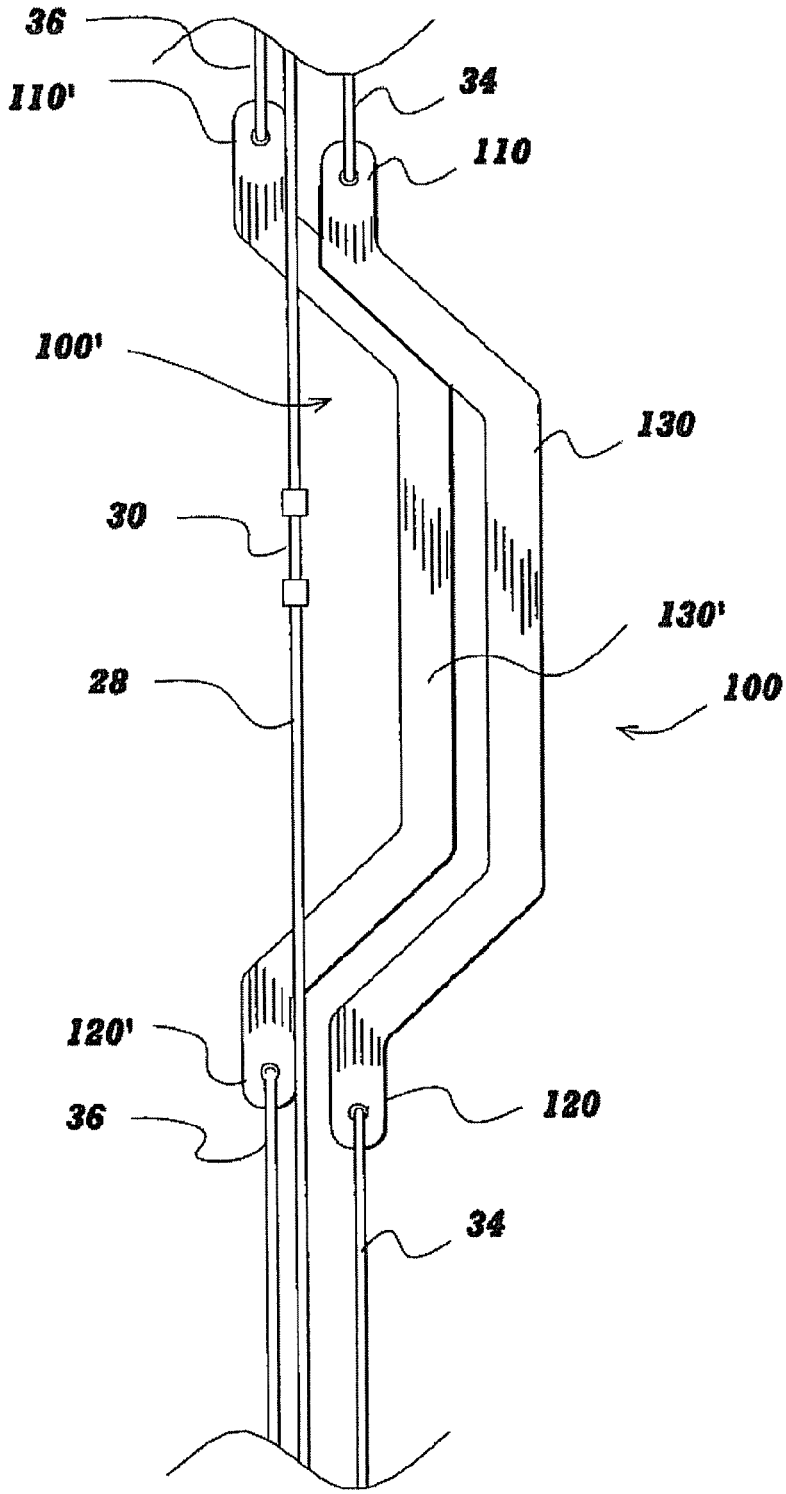
FIG. 4 is a rear view showing the bowstring, power cables and cable guard eliminators of FIG. 3 in isolation.

In the example shown in FIGS. 1 to 4, cable guard eliminators 100 and 100' are positioned along cables 34 and 36 such that when the bow is in the neutral position shown in FIG. 1, the deflection areas defined by intermediate portions 130 and 130' at least partially overlap in the region of nock 30, as shown in FIG. 2. As the user pulls back on bowstring 28, cables 34 and 36 (and thus cable guard eliminators 100 and 100') move in opposite directions, such that when the bow is in the drawn position shown in FIG. 3, cable guard eliminators 100 and 100' are substantially aligned, as shown in FIG. 4.

In other embodiments, cable guard eliminators 100 and 100' may be positioned along cables 34 and 36 so as to be substantially aligned when the bow is in the neutral position and partially overlapping when the bow is in the drawn position. Alternatively, cable guard eliminators 100 and 100' may be positioned on cables 34 and 36 to be partially overlapping when the bow is in both the neutral and drawn positions. As one skilled in the art will appreciate, the relative positions of cable guard eliminators 100 and 100' along cables 34 and 36 may vary widely, so long as some portion of the deflection area defined by each of intermediate portions 130 and 130' remains aligned with nock 30 throughout the range of motion of cables 34 and 36.

Figure 5:
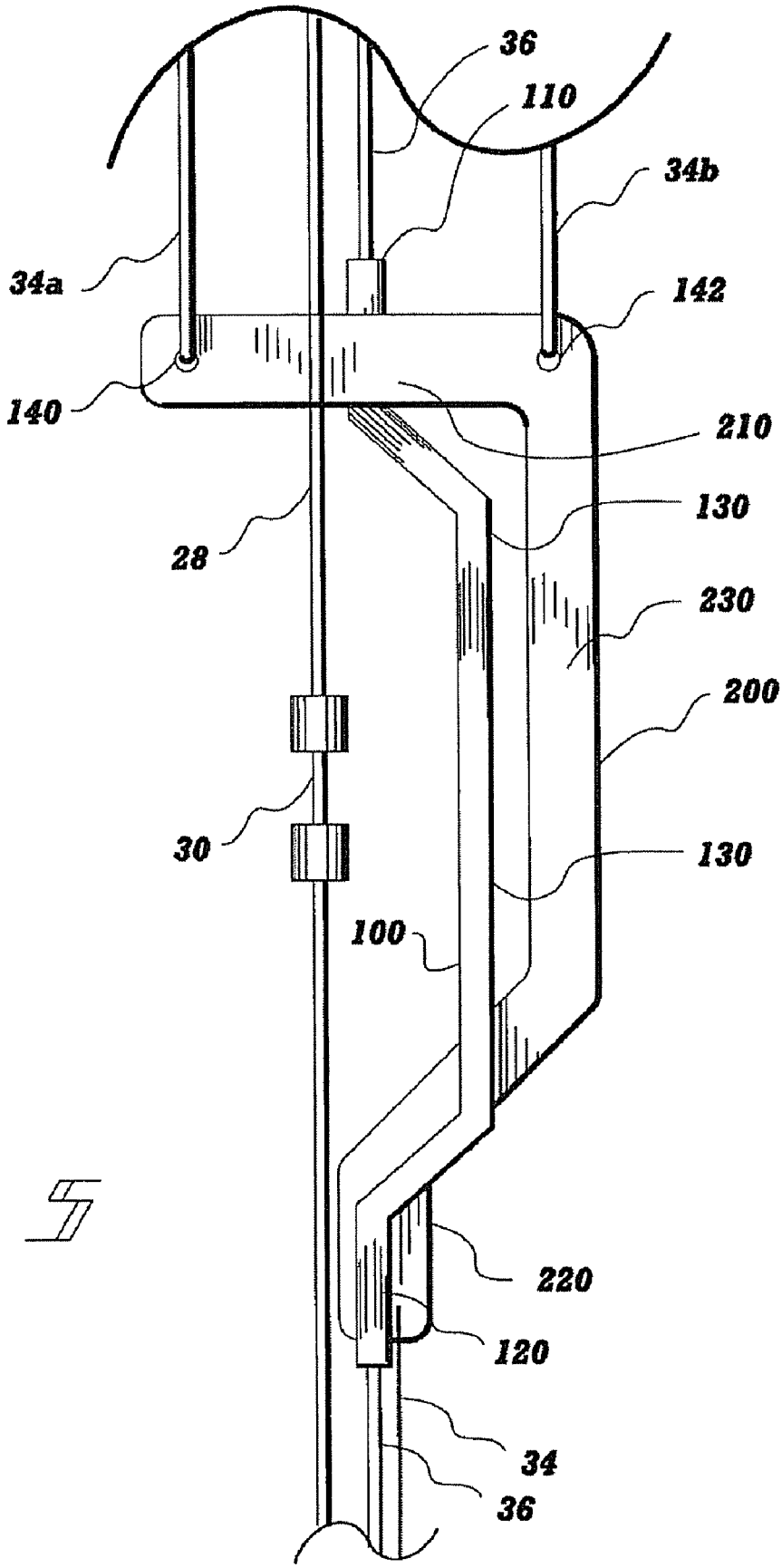
FIG. 5 is a view similar to that of FIG. 4 showing cable guard eliminators according to another embodiment of the invention.

FIG. 5 shows one cable guard eliminator 100 coupled to cable 36 and a cable guard eliminator 200 according to another embodiment of the invention coupled to cable 34. In the FIG. 5 example, cable 36 is continuous and extends through a hollow core of cable guard eliminator 100, and cable 34 is divided into two segments. The first segment of cable 34 comprises two strands 34*a* and 34*b* which are attached to a first portion 210 of cable guard eliminator 200. First portion 210 may comprise a portion which is generally perpendicularly oriented with respect to bowstring 28. Strands 34*a* and 34*b* may, for example, be attached through apertures 140 and 142 in first portion 210, and extend to opposite sides of mounting shaft 24 (not shown in FIG. 5). The second segment of cable 34 is attached to a second portion 220 of cable guard eliminator 200. Cable guard eliminator 200 also comprises an intermediate portion 230 defining a deflection area between first portion 210 and second portion 220. The deflection area defined by intermediate portion 230 may be at least as long as a range of motion of cable 34 during drawing and releasing of the bow.

Figure 6:
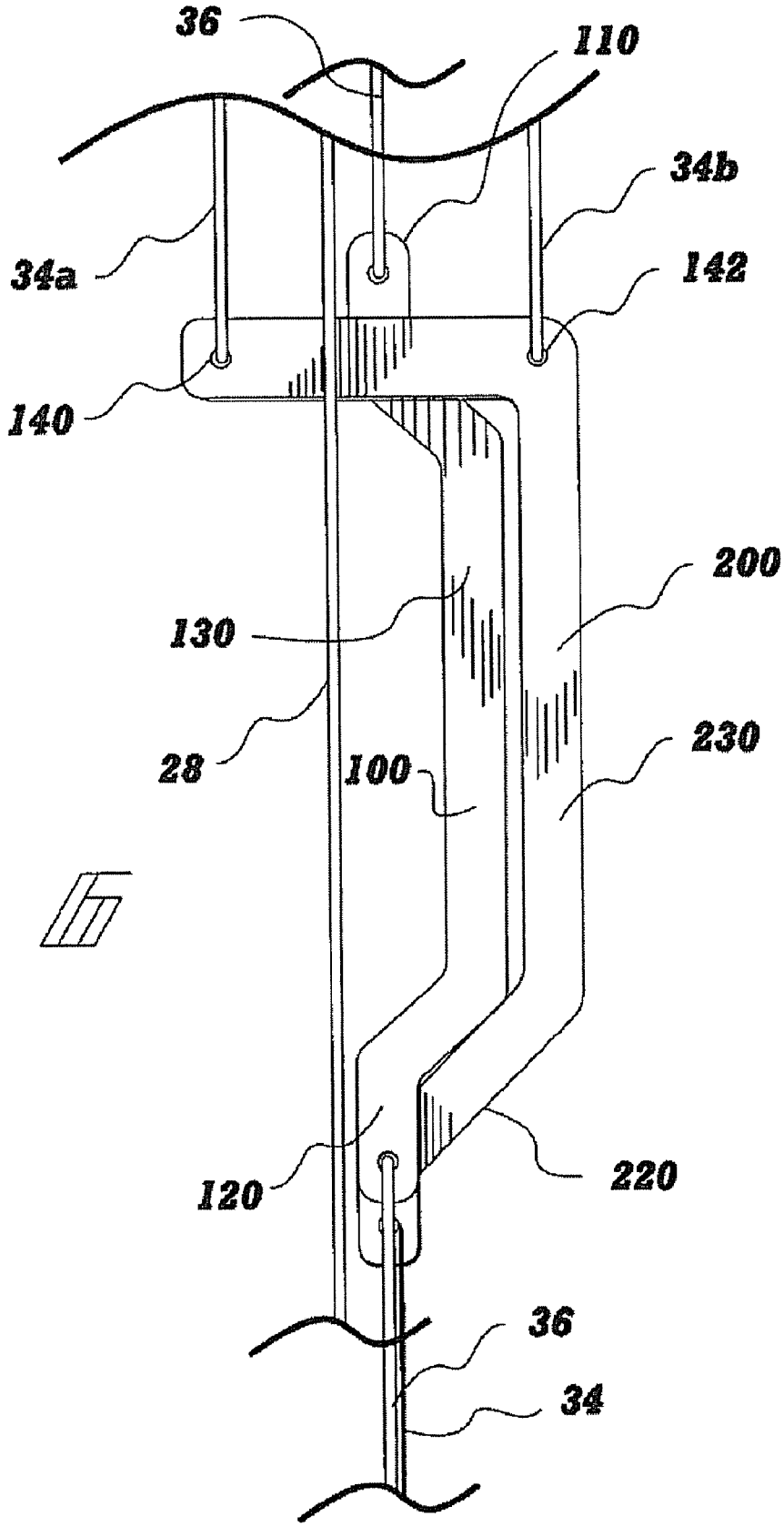
FIG. 6 is a view similar to that of FIG. 4 showing cable guard eliminators according to another embodiment of the invention.

FIG. 6 shows an example which is similar to that of FIG. 5, except that in FIG. 5 cable guard eliminator 100 is coupled to a continuous cable 36, and in FIG. 6 cable guard eliminator 100 comprises apertures (not specifically enumerated) for attaching first and second segments of cable 36.

Figure 7:
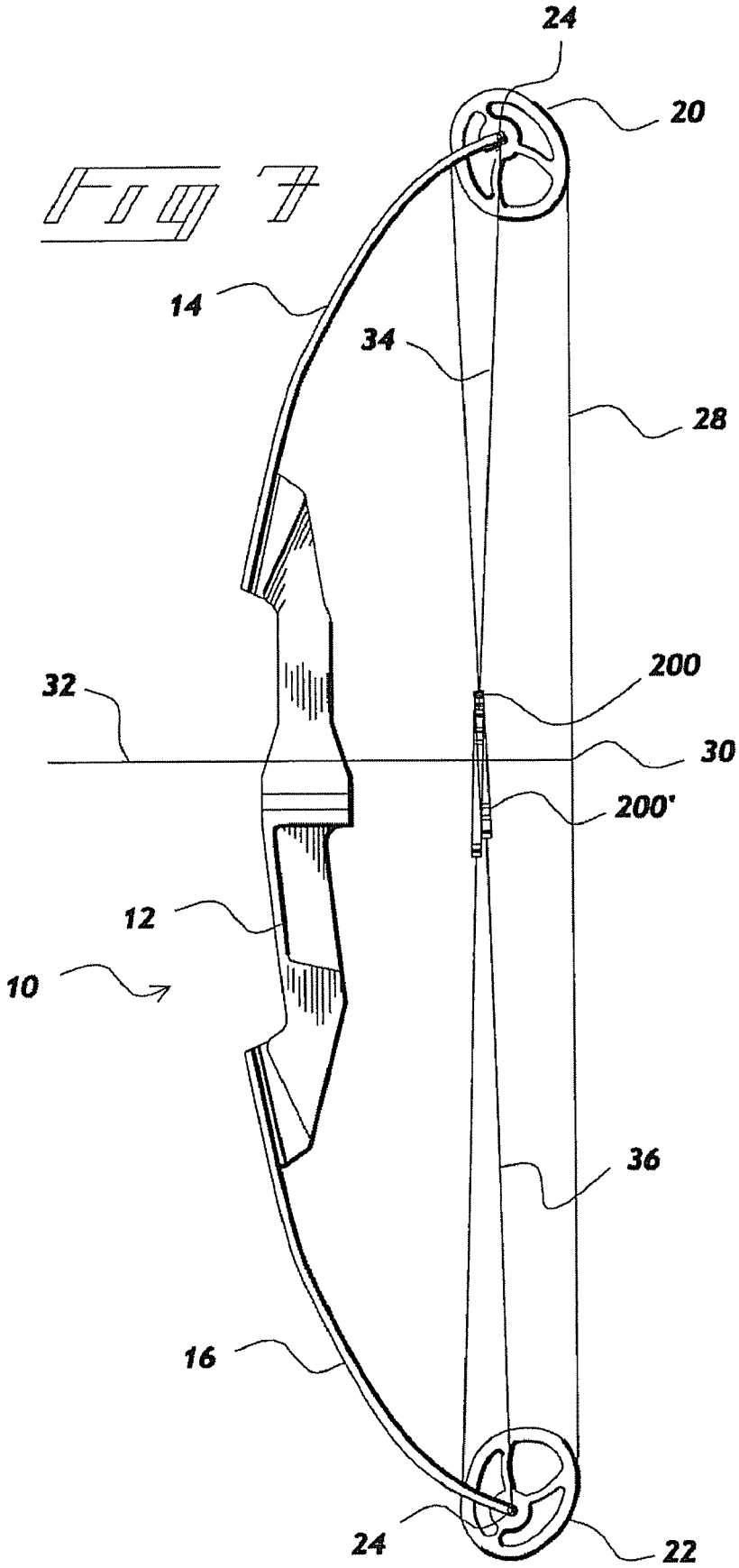
FIG. 7 is a side view of a compound bow with two cable guard eliminators coupled to power cables according to another embodiment of the invention.
Figure 8:
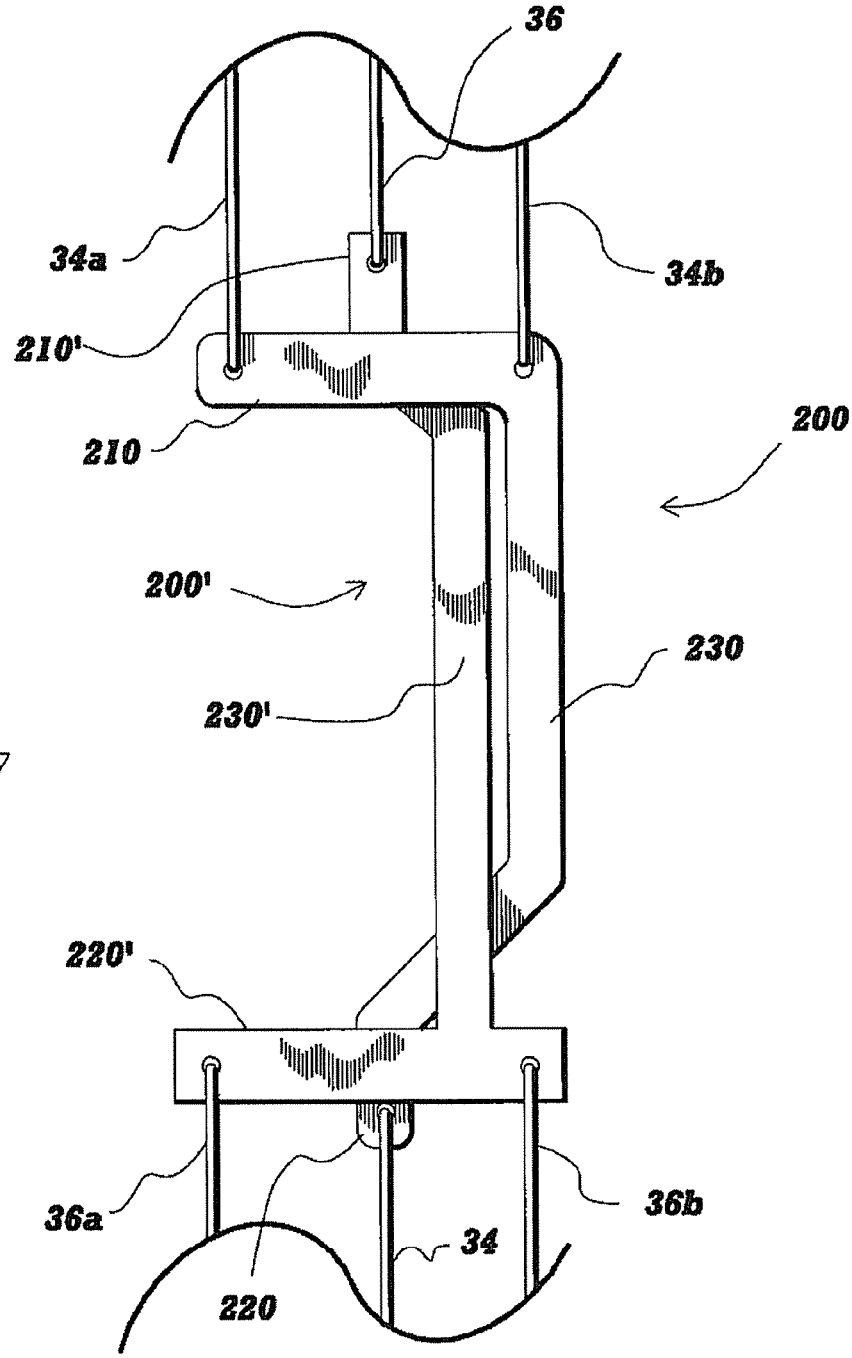
FIG. 8 is a rear view showing the power cables and cable guard eliminators of FIG. 7 in isolation.
Figure 9:
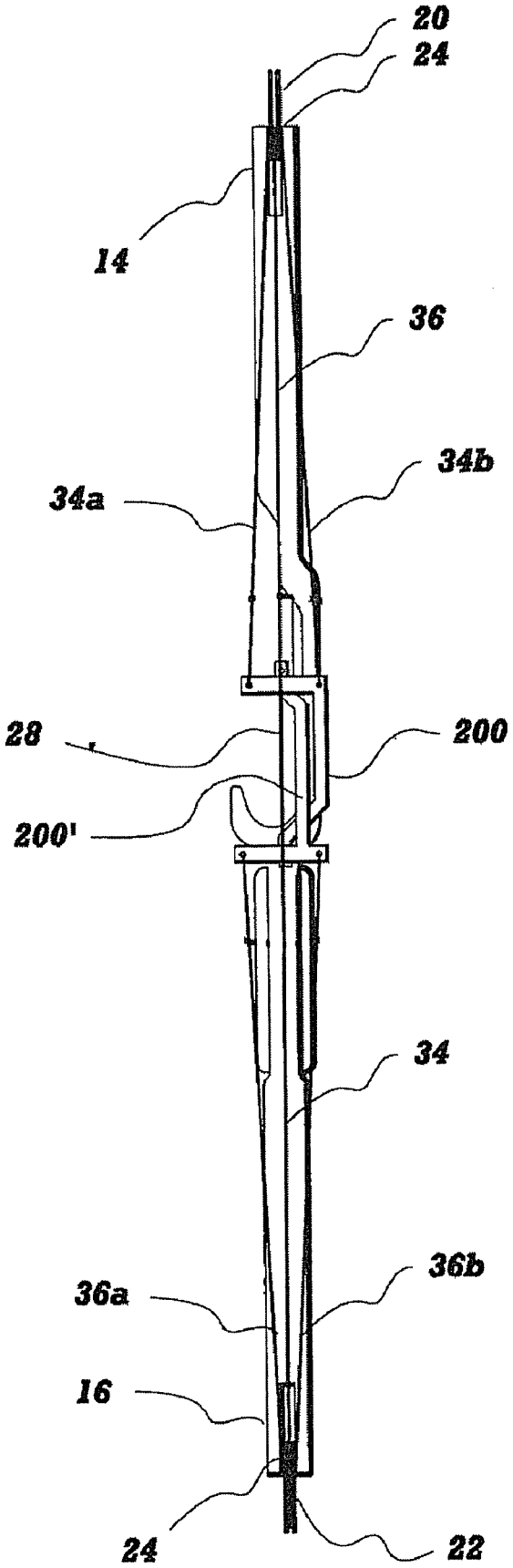
FIG. 9 is a rear view of the compound bow and cable guard eliminators of FIG. 7.

FIGS. 7 to 9 show an example wherein two cable guard eliminators 200 and 200' are coupled to cables 34 and 36.

Cable guard eliminator 200 of FIGS. 7 to 9 is the same as cable guard eliminator 200 of FIGS. 5 and 6. Cable guard eliminator 200' is of similar construction to cable guard eliminator 200, except that first portion 210' is attached to a single strand of the first segment of cable 36, and second portion 220' has a portion which is generally perpendicularly oriented with respect to bowstring 28 and is attached to two strands 36*a* and 36*b* of the second segment of cable 36.

Figure 10:
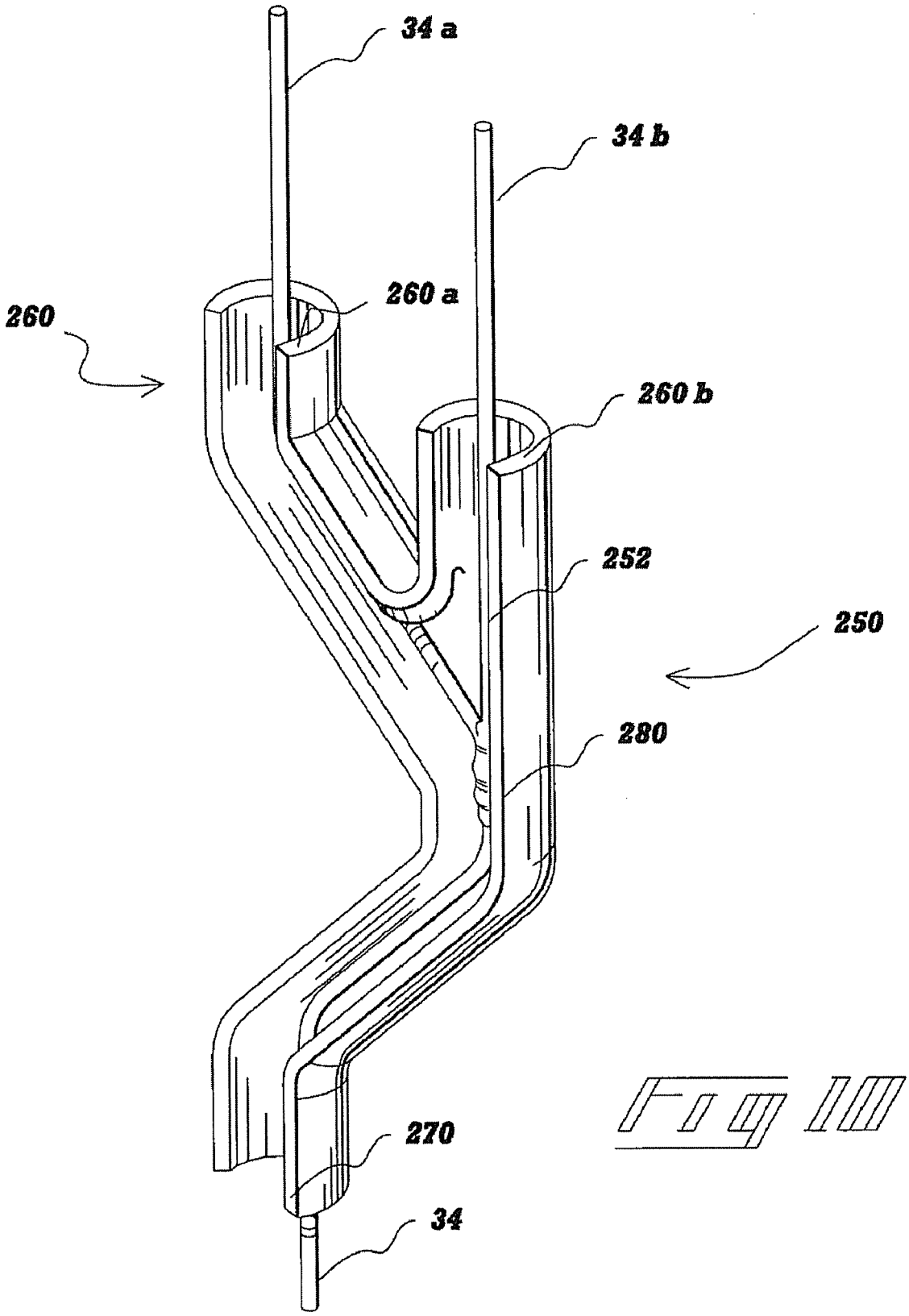
FIG. 10 shows a cable guard eliminator coupled to a power cable according to another embodiment of the invention.

FIG. 10 shows a cable guard eliminator 250 according to another embodiment of the invention. Cable guard eliminator 250 is generally Y-shaped, and defines a slot 252 therein. A continuous cable 34 which is partitioned into strands 34*a* and 34*b* is received in slot 252, with strand 34*a* extending from one arm 260*a* of a first portion 260 of cable guard eliminator 250, and strand 34*a* extending from another arm 260*b* of first portion 260. As noted above, strands 34*a* and 34*b* may be attached to mounting shaft 24 of rotating member 20 (not shown in FIG. 10). Cable 34 also extends from a second portion 270 of cable guard eliminator 250 toward rotating member 22 (not shown in FIG. 10). Cable guard eliminator 250 also comprises an intermediate portion 280 defining a deflection area between first portion 260 and second portion 270. The deflection area defined by intermediate portion 280 may be at least as long as a range of motion of cable 34 during drawing and releasing of the bow.

FIG. 11 shows a cable guard eliminator 100A which defines a slot 140A for receiving cable 34. In the FIG. 11 example, slot 140A is oriented such that the opening faces parallel to a deflection direction of intermediate portion 130A, with cable retaining hollow portions 142A formed at the angled portions. Alternatively, the opening of the slot could face perpendicularly with respect to the deflection direction (see FIG. 13). FIG. 12 shows a hollow cable guard eliminator 100B through which cable 34 is passed. FIGS. 13 and 14 show cable guard eliminators 100C and 100D which are respectively similar to cable guard eliminators 100A and 100B of FIGS. 11 and 12, except that cable guard eliminators 100C and 100D are generally rectangular in cross section. As one skilled in the art will appreciate, cable guard eliminators according to different embodiments of the invention may have different cross sections.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. Apparatus comprising a pair of cable guard eliminators for a compound bow comprising a first limb and a second limb and having a bowstring and two or more cables strung between first and second connecting elements respectively mounted near outer ends of the first and second limbs, each cable guard eliminator comprising:

a first portion from which an associated cable extends to the first connecting element;

a second portion from which the associated cable extends to the second connecting element; and, an intermediate portion defining a deflection area between the first end and the second end, wherein the deflection area of each cable guard eliminator extends away from a nocking side of the bow to provide unimpeded arrow access from the nocking side of the bow, and wherein the pair of cable guard eliminators are not interconnected, and, wherein the pair of cable guard eliminators are arranged such that the first portion of a first cable guard eliminator is in front of the first portion of a second cable guard eliminator and the second portion of the first cable guard eliminator is behind the second portion of the second cable guard eliminator.

2. Apparatus according to claim 1 wherein the deflection area of each cable guard eliminator has a length in a direction generally parallel to the associated cable at least as long as a range of motion of the associated cable, such that at least some portion of the deflection area remains aligned with an arrow path throughout drawing and release of the bowstring.

3. Apparatus according to claim 1 wherein the first portion of at least one of the cable guard eliminators is substantially parallel to the second portion.

4. Apparatus according to claim 1 wherein the first portion of at least one of the cable guard eliminators is substantially transverse to the second portion.

5. Apparatus according to claim 1 wherein the associated cable of at least one of the cable guard eliminators is continuous from the first limb to the second limb and is adapted to pass along the at least one cable guard eliminator from the first portion, through the intermediate portion, to the second portion.

6. Apparatus according to claim 5 wherein the at least one cable guard eliminator is hollow and the cable passes therethrough.

7. Apparatus according to claim 5 wherein the at least one cable guard eliminator defines a slot for receiving the cable.

8. Apparatus according to claim 5 wherein the associated cable of the at least one cable guard eliminator comprises two strands for coupling to the first connecting element and a single strand for coupling to the second connecting element, wherein the at least one cable guard eliminator is generally Y-shaped having two arms of the first portion for receiving the two strands of cable and the second portion receiving the single strand of cable.

9. Apparatus according to claim 1 wherein the associated cable of at least one of the cable guard eliminators comprises first and second discrete cable segments, wherein the first portion is configured to be attached to the first discrete cable segment and the second portion is configured to be attached to the second discrete cable segment.

10. Apparatus according to claim 9 wherein the first portion of the at least one cable guard eliminator is substantially parallel to the second portion.

11. Apparatus according to claim 9 wherein the first portion of the at least one cable guard eliminator is substantially transverse to the second portion.

12. Apparatus according to claim 11 wherein the first discrete cable segment comprises two strands and the first portion of the at least one cable guard eliminator defines two apertures for attaching the two strands of the first discrete cable segment.

13. Apparatus according to claim 1 wherein the second connecting element comprises a second mounting shaft pivotally coupling a second rotating member to the second limb, and wherein the associated cable extending from the second portion of the other of the cable guard eliminators comprises two strands coupled to the second mounting shaft on opposite sides of the second rotating member.

14. A cable guard eliminator system for a compound bow, the bow having a first limb, a second limb, and a handle mounting the first limb and second limb, the outer ends of each of the first and second limbs each mounting a rotating member on a mounting shaft, a bowstring coupled to each rotating member and extending from the first limb to the second limb, and two power cables each having a first segment attached to a mounting shaft and a second segment attached directly to a rotating member, wherein the cable guard eliminator system comprises two cable guard eliminators, each cable guard eliminator adapted to be coupled to an associated power cable, each cable guard eliminator comprising a first portion adapted to be coupled to the first segment of the associated power cable, a second portion adapted to be coupled to the second segment of the associated power cable, and an intermediate portion connecting the first portion and second portion and being deflected out of an operating plane of the bowstring, wherein the intermediate portion of each cable guard eliminator is deflected in a direction away from a nocking side of the bow to provide unimpeded arrow access from the nocking side of the bow, wherein the two cable guard eliminators are not interconnected, and wherein the cable guard eliminators are arranged such that the first portion of a first cable guard eliminator is in front of the first portion of a second cable guard eliminator and the second portion of the first cable guard eliminator is behind the second portion of the second cable guard eliminator.

15. A cable guard eliminator system according to claim 14 wherein each cable guard eliminator is selected from the group consisting of: a cable guard eliminator having the first portion substantially parallel to the second portion; a cable guard eliminator having the first portion substantially transverse to the second portion; and a cable guard eliminator having the first portion substantially in-line with the second portion, and wherein each associated power cable is continuous from the first limb to the second limb and is adapted to pass along the cable guard eliminator from the first portion, through the intermediate portion, to the second portion.

* * * * *